US011628458B2

(12) United States Patent
Gass et al.

(10) Patent No.: US 11,628,458 B2
(45) Date of Patent: Apr. 18, 2023

(54) FLUID DISPENSER

(71) Applicant: COTY INC., New York, NY (US)

(72) Inventors: Ann-Marie Gass, Darmstadt (DE); Hauke Schormair, Griesheim (DE); Massimo Morini, Bad Soden (DE)

(73) Assignee: WELLA INTERNATIONAL OPERATIONS SWITZERLAND SÀRL, Petit-Lancy (CH)

( * ) Notice: Subject to any disclaimer, the term of this patent is extended or adjusted under 35 U.S.C. 154(b) by 0 days.

(21) Appl. No.: 17/299,693

(22) PCT Filed: Dec. 3, 2019

(86) PCT No.: PCT/US2019/064184

§ 371 (c)(1),
(2) Date: Jun. 3, 2021

(87) PCT Pub. No.: WO2020/117770

PCT Pub. Date: Jun. 11, 2020

(65) Prior Publication Data

US 2022/0055051 A1 Feb. 24, 2022

Related U.S. Application Data

(60) Provisional application No. 62/774,438, filed on Dec. 3, 2018.

(51) Int. Cl.
*B05B 11/00* (2006.01)
*A47K 5/12* (2006.01)

(52) U.S. Cl.
CPC .... *B05B 11/00412* (2018.08); *B05B 11/3047* (2013.01); *A47K 5/1208* (2013.01)

(58) Field of Classification Search
CPC ..... B05B 11/00412; B05B 11/3047; B65D 83/0055
See application file for complete search history.

(56) References Cited

U.S. PATENT DOCUMENTS 3,288,334 A * 11/1966 Corsette ..... B05B 11/00412 222/321.9
3,995,772 A * 12/1976 Liautaud ..... B65D 83/0055 222/83.5
4,008,830 A * 2/1977 Meshberg ..... B65D 83/75 222/95

(Continued)

FOREIGN PATENT DOCUMENTS

JP H07223689 A 8/1995
WO 03084842 A2 10/2003
WO 2008069213 A1 6/2008

OTHER PUBLICATIONS

International Search Report issued in connection with PCT/US2019/064184 dated Mar. 18, 2020.

*Primary Examiner* — Benjamin R Shaw
*Assistant Examiner* — Randall A Gruby
(74) *Attorney, Agent, or Firm* — Victoria Friedman; Dennemeyer & Associates LLC

(57) ABSTRACT

Provided is a fluid dispenser comprising a flexible container that contains the fluid, a rigid outer container that houses the flexible container, a dispensing member for drawing the fluid out from the flexible container, and optionally an interconnection piece. Also provided is a kit and a method thereof.

14 Claims, 12 Drawing Sheets

(56) References Cited

U.S. PATENT DOCUMENTS 4,193,551 A * 3/1980 Saito ..... B05B 11/3016 222/321.9
4,216,883 A * 8/1980 Tasaki ..... B05B 11/3016 222/321.2
4,265,372 A * 5/1981 Wainberg ..... B05B 11/3081 222/85
4,322,020 A * 3/1982 Stone ..... B05B 11/00412 222/394
4,457,454 A * 7/1984 Meshberg ..... B05B 11/3066 222/207
4,457,455 A * 7/1984 Meshberg ..... B05B 11/3001 222/105
4,640,638 A * 2/1987 Bokmiller ..... A47K 11/10 401/160
4,671,428 A * 6/1987 Spatz ..... B05B 11/3032 222/105
5,108,007 A * 4/1992 Smith ..... B05B 11/0072 222/212
5,156,299 A * 10/1992 De Caluwe ..... B05B 11/00412 220/4.23
5,263,611 A * 11/1993 Trippen ..... A47K 5/1205 222/105
5,305,921 A * 4/1994 Kock ..... B65D 83/0055 222/464.2
5,445,288 A * 8/1995 Banks ..... B05B 11/3087 222/105
5,474,212 A * 12/1995 Ichikawa ..... B05B 11/0043 222/105
5,477,985 A * 12/1995 Gueret ..... B05B 11/00412 383/107
5,484,083 A * 1/1996 Joulia ..... B65D 35/08 222/107
5,524,791 A * 6/1996 Credle, Jr ..... B05B 11/0002 222/137
5,542,580 A * 8/1996 Hatakeyama ..... B05B 11/00412 222/321.7
5,620,113 A * 4/1997 Meshberg ..... B05B 11/3074 222/1
5,803,312 A * 9/1998 Credle, Jr ..... B05B 11/3084 222/137
5,873,491 A * 2/1999 Garcia ..... B05B 11/3047 222/321.7
5,875,936 A * 3/1999 Turbett ..... B05B 11/0094 222/536
6,082,586 A * 7/2000 Banks ..... B05B 11/3097 222/145.5
6,126,042 A * 10/2000 Meshberg ..... B05B 11/3059 222/376
6,142,344 A * 11/2000 Kai ..... B65D 75/5883 222/105
6,189,741 B1 * 2/2001 Behar ..... B05B 11/3047 222/321.7
6,247,613 B1 * 6/2001 Meshberg ..... B05B 11/0059 222/321.9
7,367,476 B2 * 5/2008 Law ..... B05B 11/3047 222/153.09
7,467,732 B2 * 12/2008 Bougamont ..... B05B 11/3018 222/321.2
7,481,334 B2 * 1/2009 Arghyris ..... B05B 11/3085 222/137
7,481,336 B2 * 1/2009 Arghyris ..... B05B 11/00444 222/491
7,588,170 B2 * 9/2009 van der Heijden ..... B05B 11/0097 141/2
7,770,755 B2 * 8/2010 Arghyris ..... B05B 11/3085 222/144.5
7,984,832 B2 * 7/2011 Pivonka ..... A47L 13/50 222/321.9
9,072,876 B2 * 7/2015 Nordsiek ..... A61M 35/003
9,573,151 B1 2/2017 Miller et al.
9,955,765 B2 * 5/2018 Schmitz ..... B05B 11/3059
11,084,054 B2 * 8/2021 Liang ..... B05B 11/3026
11,345,077 B2 * 5/2022 Baumann ..... B29C 63/26
2005/0230425 A1 * 10/2005 Genosar ..... B05B 11/3032 222/533
2008/0135581 A1 * 6/2008 Kennedy ..... B05B 11/3057 222/321.9
2008/0273915 A1 * 11/2008 O'Connell ..... A61L 2/26 222/23
2011/0024452 A1 * 2/2011 Moretti ..... B05B 11/3047 222/105
2020/0298263 A1 * 9/2020 Ding ..... B05B 11/3057

* cited by examiner

FLUID DISPENSER

CROSS-REFERENCE TO RELATED APPLICATIONS

This is a 35 U.S.C. 371 National Stage Patent Application of International Application No. PCT/US2019/064184, filed Dec. 3, 2019, which claims priority to U.S. Provisional Application No. 62/774,438, filed Dec. 3, 2018, each of which is hereby incorporated by reference in its entirety.

FIELD

The present invention relates to fluid dispensers, systems, kits and methods thereof.

BACKGROUND

Fluids are often packaged, stored and dispensed from bottles, for example, plastic bottles. Such bottles, however, suffer from several drawbacks. Shipping requires a large amount of packaging and storing requires a great deal of space due to the bulky, inflexible nature of the bottles. Due to the design of the bottle and/or the dispensing means for drawing the fluid out of the bottle, a good deal of the fluid is inaccessible—sometimes as much as 10-20% or even as high as 50% —and is thrown out as waste. After use, the empty bottles consume a great deal of space inside the consumer's waste or recycling bins and in landfills or recycling centers, again due to the bulky, inflexible nature of the bottles. At least because of these limitations, an improved fluid dispenser is needed.

Particularly, there is the need for providing a liquid dispenser having a greater versatility of use than conventional plastic bottles. There is also the need for providing a liquid dispenser, from which most of the fluid can be withdrawn. There is also the need for providing a liquid dispenser, wherein a non-disposable part of it is reusable, such as an outer container, thereby reducing overall waste. There is also the need for providing a liquid dispenser comprising a reusable fluid container which can be refilled, thereby reducing overall waste. There is also the need for providing a liquid dispenser comprising a disposable liquid container made from a reduced quantity of packing materials, particularly in comparison with conventional bottles, thereby limiting the storage space needed. There is also the need for providing a liquid dispenser providing a platform for customization, branding or advertising, thereby allowing dispensing various fluids.

SUMMARY

It is disclosed a fluid dispenser comprising a flexible container adapted to contain a fluid, a rigid outer container adapted to house the flexible container, and a dispensing member for drawing the fluid out from the flexible container. The flexible container, the rigid outer container and the dispensing member are attached together, either directly or indirectly, and form the fluid dispenser components. Each component comprises one or several elements. The fluid dispenser may also comprise further components e.g. an interconnection piece. Depending on the circumstances and uses contemplated, all or parts of the fluid dispenser components may be assembled together. For example, a ready-to-use fluid dispenser usually comprises a flexible container, a rigid outer container and a dispensing member, wherein the flexible container is filled with a fluid; or a to-be-filled fluid dispenser may comprise an empty flexible container, a rigid outer container and a dispenser member.

The flexible container takes up much less space, and uses less material, than a conventional bottle and can be packed closely together, and thus requires less packing material and storage space. The design of the flexible container allows for more of the fluid to be withdrawn—as much as 99% of the fluid in some instances—thus reducing waste. After use, the flexible container can be refilled and reused, thus reducing overall waste. Alternatively, the flexible container can be disposable, and such a disposable flexible container will require less material usage and take up much less space in recycling centers than a conventional bottle. The rigid outer container of the fluid dispenser is reusable, which provides a platform for customization, branding and advertising. The dispensing member can be disposable or reusable.

The Fluid Dispenser

In a first aspect, it is provided a fluid dispenser comprising a flexible container adapted to contain a fluid, wherein the flexible container comprises an opening and a neck disposed about the opening; a rigid outer container adapted to house the flexible container, wherein the rigid outer container comprises an installation opening for insertion of the flexible container within the rigid outer container and a supply opening for detachably engaging, either directly or indirectly, with the neck of the flexible container; and a dispensing member for drawing the fluid through the opening in the flexible container, wherein the dispensing member comprises a connection piece for attaching to the neck of the flexible container; wherein the flexible container is fixed within the rigid outer container by, either directly or indirectly, engaging the neck of the flexible container with the supply opening of the rigid outer container. The fluid dispenser may comprise a fluid. By "directly" is meant that a first element is engaged with/attached to/fixed to a second element without an intermediate third element. By "indirectly" is meant that a first element is engaged with/attached to/fixed to a second element via an intermediate third element.

In some embodiments, the rigid outer container comprises two joinable parts, wherein one joinable part is movable into a position for allowing access to the installation opening of the rigid outer container. The two joinable parts may comprise a body and a cover. The two joinable parts may comprise a body and a cover, wherein the body comprises the installation opening and the cover comprises the supply opening. Alternatively, the two joinable parts may comprise a body and a cover, wherein the body comprises both the installation opening and the supply opening.

In some embodiments, the cover is detachably joined to the body. The cover may be joined to the body by means of a hinge.

In some embodiments, the rigid outer container comprises at least one transparent or semi-transparent portion.

In some embodiments, the fluid dispenser further comprises an interconnection piece for, either reversibly or irreversibly, interconnecting the connection piece of the dispensing member and the neck of the flexible container.

In some embodiments, the neck of the flexible container is directly engaged with the supply opening of the rigid outer container. In alternative embodiments, the neck of the flexible container is indirectly engaged with the supply opening of the rigid outer container, for example via the connection piece of the dispensing member or via the interconnection piece.

In some embodiments, the connection piece of the dispensing member is directly attached to the neck of the flexible container. In an alternative embodiment, the connection piece of the dispensing member is indirectly attached to the neck of the flexible container, for example via the interconnection piece.

In some embodiments, the fluid dispenser further comprises an interconnection piece for interconnecting the connection piece of the dispensing member and the neck of the flexible container, and optionally for interconnecting the supply opening of the rigid outer container and the neck of the flexible container.

In some embodiments, the supply opening comprises a locking means for, either directly or indirectly, engaging the neck of the flexible container, wherein the locking means limits at least one of horizontal, vertical, and/or rotational movement of the neck of the flexible container. In some embodiments, the supply opening comprises a locking means for directly engaging the neck of the flexible container. In other embodiments, the supply opening comprises a locking means for directly engaging the connection piece of the dispensing member. In alternative embodiments, the supply opening comprises a locking means for directly engaging the interconnection piece.

In some embodiments, the neck of the flexible container comprises at least one annular ring, wherein the annular ring directly and detachably engages with the supply opening thereby fixing the flexible container within the rigid outer container. In alternative embodiments, the connection piece of the dispensing member comprises at least one annular ring, wherein the annular ring directly and detachably engages with the supply opening thereby fixing directly the dispensing member to, and indirectly the flexible container within, the rigid outer container. In alternative embodiments, the interconnection piece comprises at least one annular ring, wherein the annular ring directly and detachably engages with the supply opening thereby fixing directly interconnection piece to, and indirectly the dispensing member to and the flexible container within, the rigid outer container.

In some embodiments, the neck of the flexible container comprises outer screw threads and the connection piece of the dispensing member comprises inner screw threads, wherein the outer screw threads are suitable to engage the inner screw threads. In alternative embodiments, the neck of the flexible container comprises outer screw threads and the interconnection piece of the dispensing member comprises inner screw threads, wherein the outer screw threads are suitable to engage the inner screw threads.

In some embodiments, the connection piece of the dispensing member is attached to the neck of the flexible container by a clamping means. In alternative embodiments, the interconnection piece is attached to the neck of the flexible container by a clamping means.

In some embodiments, the interconnection piece comprises outer screw threads and the connection piece of the dispensing member comprises inner screw threads, wherein the outer screw threads are suitable to engage the inner screw threads.

In some embodiments, the connection piece of the dispensing member is attached to the interconnection piece by a clamping means.

In some embodiments, the dispensing member further comprises a pump means and a conveying tube, wherein the conveying tube is disposed within the flexible container when the connection piece of the dispensing member is, either directly or indirectly, attached to the neck of the flexible container.

The fluid dispenser is designed to stand on a flat horizontal surface, such as a table. The main axis of the fluid dispenser is orthogonal to the resting surface and passes from the resting base (also called the bottom face or space) of the fluid dispenser to the dispensing head at the top of the fluid dispenser, when standing on the resting surface. The terms "bottom", "top", "downwards" and "upwards" are defined according to the standing position of the fluid dispenser.

The dimensions and shapes of the fluid dispenser and its components, as well as the type of components selected, are chosen to accommodate the fluid to be dispensed.

The Flexible Container

The fluid dispenser comprises a flexible container. The flexible container is detachably fixed within the rigid outer container. The flexible container may be detachably and directly fixed within the rigid outer container. Alternatively, the flexible container may be detachably and indirectly fixed within the rigid outer container, for example via the connection piece of the dispensing member or via the interconnection piece.

The flexible container may be a bag, a pouch, or any other suitable flexible container.

The flexible container is adapted to contain a fluid.

The flexible container comprises an opening. The opening is adapted for delivering the fluid. The opening may be covered or sealed.

The flexible container comprises a neck. The neck is disposed about the opening.

The flexible container may also comprise a container portion. The container portion is flexible. The container portion comprises an expandable inner volume, adapted to contain the fluid. For example, the expandable inner volume may be from 0.1 to 5 litres, such as from 0.1 to 0.5 l, alternatively from 0.5 to 1.5 l, alternatively from 1.5 to 2.5 l, alternatively from 2.5 to 3.5 l, alternatively from 3.5 to 4.5 l, alternatively from 4.5 to 5l.

The container portion and the neck may be a unitary construction (i.e. one component). Alternatively, the container portion and the neck may be separate components, preferably permanently fixed to each other.

The flexible container may be made from a thin, tear-resistant material. The thin, tear-resistant material may be selected from the group consisting of plastic, foil or laminated material. The plastic may be selected from polyethylene, high density polyethylene, low density polyethylene, linear low-density polyethylene, polypropylene, polyethylene terephthalate, polyamide or mixtures thereof. The foil may be aluminum. The laminated material may be a laminate of aluminum and plastic.

The flexible container may be made of an opaque material, a transparent material, a semi-transparent material, a translucent material or combinations thereof. The flexible container may be made of a combination of a first material and a second material. The first material may be an opaque material, a semi-transparent material or a translucent material, while the second material may be a transparent material. The second material of transparent material may form a window, allowing the consumer to see easily the quantity of fluid contained within the flexible container.

When present, the container portion may be made from any of above-mentioned materials.

The flexible container may be a disposable flexible container or a reusable flexible container. A reusable flexible container may be refilled with a fluid, as needed.

The Neck

The flexible container comprises a neck. The neck is detachably engaged with the supply opening of the rigid outer container. The neck may be detachably and directly attached with the supply opening of the rigid outer container. Alternatively, the neck may be detachably and indirectly attached with the supply opening of the rigid outer container, for example via the connection of the dispensing member or via the interconnection piece.

The outer surface of the neck may be cross-sectionally circular in shape or angular-shaped. The inner surface of the neck may be circular in shape or angular-shaped. The angular shape may be selected from a triangular shape, a square shape, a pentagonal shape, a hexagonal shape or any other suitable shape. The shape of the inner surface of the neck may correspond to the shape of the outer surface.

The neck may be longitudinally cylindrical in shape or any other suitable tubular shape.

The neck may be made from the same material as the container portion, or alternatively from a different material. When made from a different material, the neck may be less flexible (more rigid) than the container portion.

The neck may comprise at least one annular ring; preferably one or two annular rings.

The neck may be, either reversibly or permanently, fixed to the connection piece of the dispensing member.

The neck and the connection piece of the dispensing member may comprise corresponding means to allow the reversible connection of the flexible container and the dispensing member. The corresponding means may be selected from corresponding screw threads, reversible clamping means or any alternative suitable means. The outer surface of the neck may comprise outer screw threads designed to engage with inner screw threads comprised on the inner surface of the connection piece of the dispensing member.

The neck and the connection piece of the dispensing member may comprise corresponding means to allow the irreversible connection of the flexible container and the dispensing member. The corresponding means may be irreversible clamping means.

The neck may comprise two portions, au upper portion which is designed to reversibly engage with the connection piece of the dispending member, and a lower portion which is attached to the container portion. The upper portion and the lower portion may have different shapes. The upper portion may be longitudinally cylindrical in shape. It may have any suitable cross-sectional shape as defined above. The lower portion may have a shape and dimensions corresponding to the shape and dimensions of the container portion. Alternatively, or cumulatively, the lower portion may have a shape and dimensions corresponding to the shape and dimensions of the rigid outer container.

The Opening of the Flexible Container

Prior use, the opening of the flexible container may be covered or sealed with a cover, a lid, a cap or combinations thereof. The opening of the flexible container may be covered or sealed simultaneously or alternatively by a cover/a lid and a cap.

The cover may be a foil-type cover.

The cap may be a removable cap. The cap may comprise inner screw threads which engages with the outer screw threads of the neck. Alternatively, the cap and the neck may comprise corresponding reversible clamping means.

The Rigid Outer Container

The fluid dispenser comprises a rigid outer container.

The rigid outer container is adapted to house the flexible container. The dimensions and shape of the rigid outer container are chosen, so that the flexible container fits into the rigid outer container, when fully filled with the fluid.

The rigid outer container comprises at least one installation opening, for inserting the flexible container within the rigid outer container.

The rigid outer container comprises a supply opening, for detachably, either directly or indirectly, engaging with the neck of the flexible container.

The rigid outer container may be a unitary construction (one part) or may comprise at least two parts, which may be joined to each other.

The rigid outer container, or the parts forming it, may be made of a material selected from plastic, metal, wood, bamboo or combination thereof. The plastic may be selected from polyethylene, high density polyethylene, polyvinyl chloride, polypropylene, polycarbonate, acrylonitrile butadiene styrene or mixtures thereof. The metal may be selected from aluminum, stainless steel or mixtures thereof.

The rigid outer container, or the parts forming it, may be made of an opaque material, a transparent material, a semi-transparent material, a translucent material or a combination thereof. The rigid outer container may be made of a combination of a first material and a second material. The first material may be an opaque material, a semi-transparent material, or a translucent material, while the second material may be a transparent material. The second material of transparent material may form a window. The window of transparent material of the rigid outer container may be placed vis-à-vis the window of transparent material of the flexible container, so that the fluid contained within the flexible container may be seen easily.

The rigid outer container may comprise a hole, through which the flexible container may be seen. In such embodiments, instructions or any suitable mentions and illustrations may be printed on the flexible container, for being readable by the user upon use.

The rigid outer container may have any suitable cross-sectional geometric shape. The rigid outer container may be cross-sectionally circular in shape, oval in shape or angular-shaped. The angular shape may be selected from a triangular shape, a square shape, a pentagonal shape, a hexagonal shape or any other suitable shapes. The rigid outer container may also have any suitable complex cross-sectional shape.

In one embodiment, the rigid outer container has a cuboid shape, particularly a rectangular cuboid shape or a cubic shape. Such type of containers comprises six different faces i.e. a top face, a bottom face and four side faces. The faces may be rectangular or square. The faces may have any suitable length and/or a width, for example for fitting a flexible container having an expandable inner volume of from 0.1 to 5 litres. The top face usually comprises the supply opening. The bottom face usually rests on the horizontal flat surface. Different configurations are possible, as far as it comprises both an installation opening and a supply opening, and it can stand on a flat surface.

The rigid outer container may comprise maximum five faces including the top face, wherein the space left opened (the "absent sixth face") forms a permanent installation opening. The faces of the rigid outer container may comprise an outer surface and an inner surface. The faces may be substantially flat, bended or alternatively may comprise a pattern, either on one surface only or on both surfaces. The rigid outer container may comprise four side faces and a top face, but no bottom face, thereby forming a bottom installation opening. Alternatively, the rigid outer container may comprise a top face, a bottom face and three side faces, but not a fourth side face, thereby forming a side installation opening. Alternatively, the rigid outer container may comprise a top face, a bottom face and two opposite side faces. Alternatively, the rigid outer container may comprise a top face, a bottom face and two contiguous side faces. Alternatively, the rigid outer container may comprise a top face, a bottom face and one side face. In embodiments wherein at least one side face is missing, the side face(s) also forms(–) a hole, through which the flexible container remains visible upon use, rendering any suitable mentions and illustrations printed on the flexible container readable by the user upon use. The installation opening may be delineated by the edges of the faces surrounding it, thereby forming a frame.

The rigid outer container may comprise at least two parts, preferably two parts, one joignable part (the cover) being releasably mounted on a main part (the body) and being movable into a position for allowing access to the installation opening of the rigid outer container. The main part may form a body comprising an installation opening and the joignable part may form a cover, adapted to fit securely on the body over the installation opening. The installation opening and the corresponding cover may be located on the top of the body and the cover may include the supply opening. Alternatively, the installation opening and the corresponding cover may be located on the side of the body, and the body may include the supply opening. Alternatively, the installation opening and the corresponding cover may be located at the bottom of the body, and the body may include the supply opening. When the rigid outer container has a cuboid shape, the cover may form one of the six faces, the remaining faces forming the body of the fluid dispenser. Depending on the design of the fluid dispenser, the joignable part (the cover) may form the top face, one of the side faces or the bottom face.

The cover may be slightly larger that the frame delineating the installation opening of the body. The cover may comprise a rim that runs along its outer edge towards the inside of the body (when mounted on it) such that when the cover is placed on the body, the rim is in contact with the outside of the body, thus holding the cover in place on the body. Alternatively, the cover may be substantially the same size as the frame delineating the installation opening of the body. The cover may comprise a rim that runs parallel to its outer edge and projecting towards the inside of the body (when mounted on it) and located at a certain distance inward from the outer edge. When the cover is placed on the body, the rim is in contact with the inside of the body, thus holding the cover in place on the body. Alternatively, the cover may be slightly smaller than the frame forming the installation opening. The body may comprise a rim than runs parallel to the edges of the installation opening, and which may be located a certain distance inward from the edges of the installation opening, such that when the cover is placed on the body, the inner face of the over rests on the rim, thus holding the cover in place on the body.

The removable cover may be separate from the body. Alternatively, the cover may be locked or fixed in place on the body. Particularly, the cover may be fixed by a slide-lock, twist-lock or bayonet-type mount. Alternatively, the cover may be attached to the body. Particularly, the cover may be attached to the body by means of a hinge. The body and/or the cover may also comprise a latch or a locking means, in order to keep the cover in a closed position.

The Supply Opening

The supply opening of the rigid outer container may be a recess. The neck of the flexible container may be slid, optionally together with the connection piece of the dispensing member (if present) or the interconnection piece (if present), into the recess either before or after the dispensing member is attached to the neck. The dimensions and shape of the recess is adapted to the dimensions and shape of the neck and/or the annular ring of the flexible container or the dimensions and shape of the connection piece or the dimensions and shape of the neck of the interconnection piece.

For proper operation of the liquid dispenser, it is preferable to form a secure fit between the neck of the flexible member, the connection piece of the dispensing member or the interconnection piece, on one hand, and the recess, on the other hand.

The supply opening may comprise a locking means for engaging, either directly or indirectly, the neck of the flexible container. The locking means is adapted to limit horizontal, vertical and/or rotational movement of the neck of the flexible container, the connection piece of the dispensing member or the interconnection piece. The width of the recess maybe slightly smaller than the diameter of the neck, the connection piece of the dispensing member or the interconnection piece. The neck, the connection piece of the dispensing member or the interconnection piece may then be sufficiently flexible to slightly deform as it is fixed within the recess. Alternatively, the width of the recess may be substantially the same as or greater than the diameter of the neck, the connection piece of the dispensing member or the interconnection piece. In such case, an annular ring as defined herewith may be disposed on the neck, the connection piece of the dispensing member or the interconnection piece. The diameter of the annular ring may be greater than the width of the recess. The flexible container may also be used with a dispensing member comprising a connection piece with a diameter that is greater than the width of the recess.

The recess may have different shapes. The recess may be open or closed. The shape of the end of the recess may be semicircular, adapted to receive a round neck, a round connection piece, a round interconnection piece and/or an annular ring. The shape of the end of the recess may be angular-shaped, adapted to receive an angular-shaped neck, an angular-shaped connection piece, the interconnection piece and/or annular ring. The angular shape of the recess, or at least its end portion, may be selected from a triangular shape, a square shape, a pentagonal shape, a hexagonal shape, and any other suitable shape.

The recess may comprise a protrusion or a tooth, which is designed to reversibly fit with a corresponding notch or groove of the neck, the connection piece of the dispensing member, the interconnection piece or the angular ring of the flexible container.

The recess may comprise a means to facilitate the connection between, particularly to allow the reversible fit of, the flexible container, optionally together with the dispensing member, and the rigid outer container. The neck, the connection piece of the dispensing member, the interconnection piece or the annular ring may comprise corresponding means. The recess may comprise a connection means selected from the group consisting of a protrusion, a tooth, a notch, a groove or any suitable connection means. The annular ring, the neck, the connection piece of the dispensing member or the interconnection piece may comprise the corresponding means respectively selected from a notch, a groove, a protrusion, a tooth, or any suitable corresponding connection means. Alternatively, or cumulatively, the edge(s) of the recess may be lined with at least one seal. The seal may be selected from rubber, silicone, or any other suitable seal.

The recess may be wider at the edge nearest the installation opening and tapers toward the end of the recess. Alternatively, the recess may have a "lollipop" shape with a straight section that ends at a slightly wider circular portion. Alternatively, the recess may be a hole.

The Dispensing Member

The fluid dispenser comprises a dispensing member. The dispending member may comprise a conveying tube, a connection piece and a moveable head.

The dispensing member is adapted for drawing the fluid through the opening of the flexible container.

The dispensing member may be any conventional dispensing member. A suitable dispensing member may be a pump-type apparatus, including a lotion-pump type apparatus or a spray-pump type apparatus. The dispensing member may then further comprise a pump means. The dispensing member may be selected depending on the type of fluid to be dispensed. Spray-pump type apparatus may be used with low-viscosity fluid. Lotion-pump type apparatus may be used with high-viscosity fluid. A pump-type apparatus may comprise a conveying tube, a connection piece and a moveable head.

The dispensing member comprises a connection piece, for attaching the neck of the flexible container. The connection piece of the dispensing member may be attached directly to the neck of the flexible container. Alternatively, the connection piece of the dispensing member may be attached indirectly to the neck of the flexible container, via an interconnection piece as defined herewith. Any conventional means may be used for attaching the connection means, or the interconnection piece, and the neck. Suitable conventional means may be selected from threads, bayonet or clipping. The connection piece or the interconnection piece, may be an annular collar. The annular collar may comprise inner screw threads designed to engage with the corresponding outer screw threads of the neck.

The connection piece may be reversibly attached to the neck of the flexible container, optionally via an interconnection piece. In such case, the flexible container may be removed after use and the dispensing member may be reused. Alternatively, the connection piece may be irreversibly attached to the neck of the flexible container, optionally via an interconnection piece. In such case, the flexible container and the dispensing member are both disposed of after use.

The connection piece may have any suitable shape and dimensions. In some embodiment, the connection piece may have an elongated shape, for projecting the moveable head at a certain distance above the rigid outer container. An elongated connection piece may also be suitable for the covering the pump.

The moveable head may have a radially projecting outlet, from which the fluid is dispensed upon actuation.

The conveying tube may be flexible or rigid. The conveying tube may be straight, angled or curved. In some embodiments, the conveying tube is of sufficient length to reach to or near to the bottom of the flexible container. It allows dispensing the majority of, even nearly all, from the flexible container. In alternative embodiments, the conveying tube is of a shorter length than the length of the flexible container, for example about two thirds of the length.

Interconnection Piece

The fluid dispenser may further comprise an interconnection piece. The interconnection piece may be used to interconnect (attach/engage/fix together) at least two components together, particularly to interconnect the neck of the flexible container and the connection piece of the dispensing member, and also optionally the neck of the flexible container and the supply opening of the rigid outer container.

The interconnection piece may have an elongated shape for projecting the dispensing member at a certain distance above the rigid outer container.

The interconnection piece may be reversibly attached to the neck of the flexible container. Alternatively, the interconnection piece may be permanently attached to the neck of the flexible container.

The interconnection piece may be reversibly attached to the connection piece of the dispensing member. Alternatively, the interconnection piece may be permanently attached to the connection piece of the dispensing member.

The interconnection piece may be reversibly engaged with the supply opening of the rigid outer container.

The Annular Ring

The neck of the flexible container, the connection piece of the dispensing member or the interconnection piece may comprise at least one annular ring.

In one embodiment, the annular ring(s) is(are) adapted to facilitate the connection between the flexible container and the rigid outer container. In such case, the flexible container is directly connected to the rigid outer container via the annular ring(s). In an alternative embodiment, the annular ring(s) is(are) adapted to facilitate the connection between the connection piece of the dispensing member and the rigid outer container. In an alternative embodiment, the annular ring(s) is(are) adapted to facilitate the connection between the interconnection piece and the rigid outer container.

The shape of the annular ring at least partly reversibly fits the corresponding shape of the supply opening of the rigid outer container. The reversible fit of at least part of the annular ring of the flexible container, the dispensing member or the interconnection piece with the supply opening of the rigid outer container limits the horizontal, vertical and/or the rotational movement of the neck of the flexible container, the dispensing member or the interconnection piece within the supply opening.

The outer surface of the annular ring may be cross-sectionally circular in shape or angular-shaped. The angular shape may be selected from a triangular shape, a square shape, a pentagonal shape, a hexagonal shape or any other suitable shape.

The reversible fit of at least part of the annular ring of the flexible container, the dispensing member or the interconnection piece with the supply opening of the rigid outer container may be achieved in different ways.

The neck of the flexible container, the connection piece of the dispensing member or the interconnection piece may comprise one annular ring. The annular ring may be positioned on the neck to form a gap having a certain height between the bottom of the annular ring and the top of the container portion. The height of the gap may be generally equal or nearly equal to the thickness of the portion of the rigid outer container forming the edge of the supply opening. Alternatively, the height of the gap may be smaller than the thickness of the portion of the rigid outer container forming the edge of the supply opening, thereby requiring a certain degree of flexibility of the material that makes up the annular ring and/or the top of the container portion. Alternatively, the height of the gap may be larger than the thickness of the material forming the edge of the supply opening.

The neck of the flexible container, the connection piece of the dispensing member or the interconnection piece may comprise two annular rings. A first annular ring (bottom annular ring) may be located proximally and the second annular ring (top annular ring) may be located distally from the top of the container portion. The annular rings are positioned on the neck, the connection piece or the interconnection piece to form a gap having a certain height between the top annular ring and the bottom annular ring. The height of the gap may be generally equal or nearly equal to the thickness of the portion of the rigid outer container surrounding the supply opening.

The annular ring and the supply opening of the rigid outer container may comprise corresponding means to facilitate the connection between, particularly to allow the reversible fit of the flexible container, the dispensing member or the interconnection piece, on one hand, and the rigid outer container, on the other hand. The corresponding means may be selected from a notch and the corresponding protrusion, a groove and the corresponding tooth, or any other suitable corresponding means. The annular ring may comprise a notch and the supply opening a corresponding protrusion. Alternatively, the annular ring may comprise a protrusion and the supply opening a corresponding notch. Alternatively, the annular ring may comprise a groove and the supply opening a corresponding tooth. Alternatively, the annular ring may comprise a tooth and the supply opening a corresponding groove.

Fluid Dispensing System

In a second aspect, the present invention relates to a fluid dispensing system. The fluid dispensing system comprises the fluid dispenser as defined herewith, and a fluid. The fluid is contained in the flexible container and dispensed via the dispensing member.

The Fluid

The fluid may be any suitable fluid. The fluid may be selected from a personal care product (or composition), a home care product or any other suitable product. Particularly, the fluid may be selected from the group consisting of hair products, cleansing products, skin care products, fragrance products. The hair products may be selected from the group consisting of shampoos, conditioners, masks, colouring/dyeing/bleaching products. The cleansing product may be selected from the group consisting of soap, a facial scrub or a hand sanitizer. The skin care product may be selected from the group consisting of moisturizing product, a hand/face/body lotion or a sunscreen product. The fluid may have a suitable viscosity. Depending on the applications, the fluid may have a viscosity from about 1 to about 500,000 mPa·s.

The fluid dispenser may be filled with the fluid upon manufacture and provided to the user as a ready-to-use system. Alternatively, the fluid dispenser may not be filled upon manufacture (empty flexible container) and provided to the user as a to-be-filled fluid dispenser. In such case, the user fills the flexible container with a suitable fluid, for obtaining a ready-to-use system.

Kits

In a third aspect, the present invention relates to a kit for dispensing a fluid from a fluid dispenser, as defined herewith, wherein the kit comprises a rigid outer container, at least one flexible container, at least one dispensing member, optionally at least one interconnection piece to be assembled together prior use.

The kit may also comprise a fluid. The fluid may be contained already in at least one flexible container. The kit may comprise only one pre-filled flexible container or a set of at least two prefilled flexible containers.

Alternatively, the fluid may be provided in a separate container for storing the fluid. The kit may thus comprise at least one empty flexible container, to be filled with the fluid. The separate container may be a refill container, comprising several times the maximum volume of the expandable inner volume of the flexible container (container portion). Upon use, when the flexible container is nearly empty, a volume of fluid may be poured from the separate container to the flexible container.

The kit may also comprise a set of instructions. The set of instructions may help the user to assemble the different components of the fluid dispenser and/or to fill/refill the flexible container with the fluid.

Methods

The fluid dispenser may be assembled in any suitable way.

In a fourth aspect, it is disclosed a method for assembling the fluid dispenser according to the present invention comprising the following steps:

- providing a flexible container comprising an opening and a neck disposed about the opening;
- providing a rigid outer container comprising an installation opening and a supply opening;
- providing a dispensing member comprising a connection piece;
- optionally providing an interconnection piece;
- attaching, directly or indirectly with the interconnection piece, the connection piece of the dispensing member to the neck of the flexible container;
- inserting the flexible container within the rigid outer container via the installation opening;
- detachably engaging the supply opening of the rigid outer container with the neck of the flexible container, either directly or indirectly with the connection piece of the dispensing member or the optional interconnection piece, thereby detachably fixing the flexible container within the rigid outer container.

The step of attaching the dispensing member to the flexible container may be carried out before the step of inserting the flexible container within the rigid outer container and the step of fixing the flexible container within the rigid outer container. Alternatively, the step of attaching the dispensing member to the flexible container may be carried out after the step of inserting the flexible container within the rigid outer container and the step of fixing the flexible container within the rigid outer container.

The flexible container may be provided as an empty flexible container or as a prefilled flexible container. When the flexible container is provided as an empty container, the method may comprise the additional step of filling the flexible container with a fluid. The filling step may be carried out before the step of attaching the dispensing member to the flexible container. The filling step may be carried out before or after fixing the flexible container within the rigid outer container.

The conveying tube of the dispensing member may be inserted into the neck of the flexible container, through the opening. The connection piece of the dispensing member may then be attached to the neck of the flexible container, either directly or indirectly via the interconnection piece. The flexible container is then inserted into the installation opening of the rigid outer container, by engaging the neck of the flexible container or the connection piece of the dispensing member or the interconnection piece with the supply opening of the rigid outer container. Alternatively, prior to attaching the dispensing member to the neck of the flexible container or the connection piece of the dispensing member or the interconnection piece, the flexible member may be inserted into the installation opening of the rigid outer container, by engaging the neck of the flexible container with the supply opening of the rigid outer container. The dispensing member may then be attached to the neck.

Once the flexible container is mounted within the rigid outer container and the dispensing member, then the dispensing member may be actuated to dispense the fluid from the flexible container. Pressing down the moveable head of the dispensing member allows suctioning the fluid through the conveying tube and out through the outlet.

DESCRIPTION OF THE DRAWINGS

Embodiments of the invention will be described with reference to the following Figures.

DETAILED DESCRIPTION

Figure 1A:
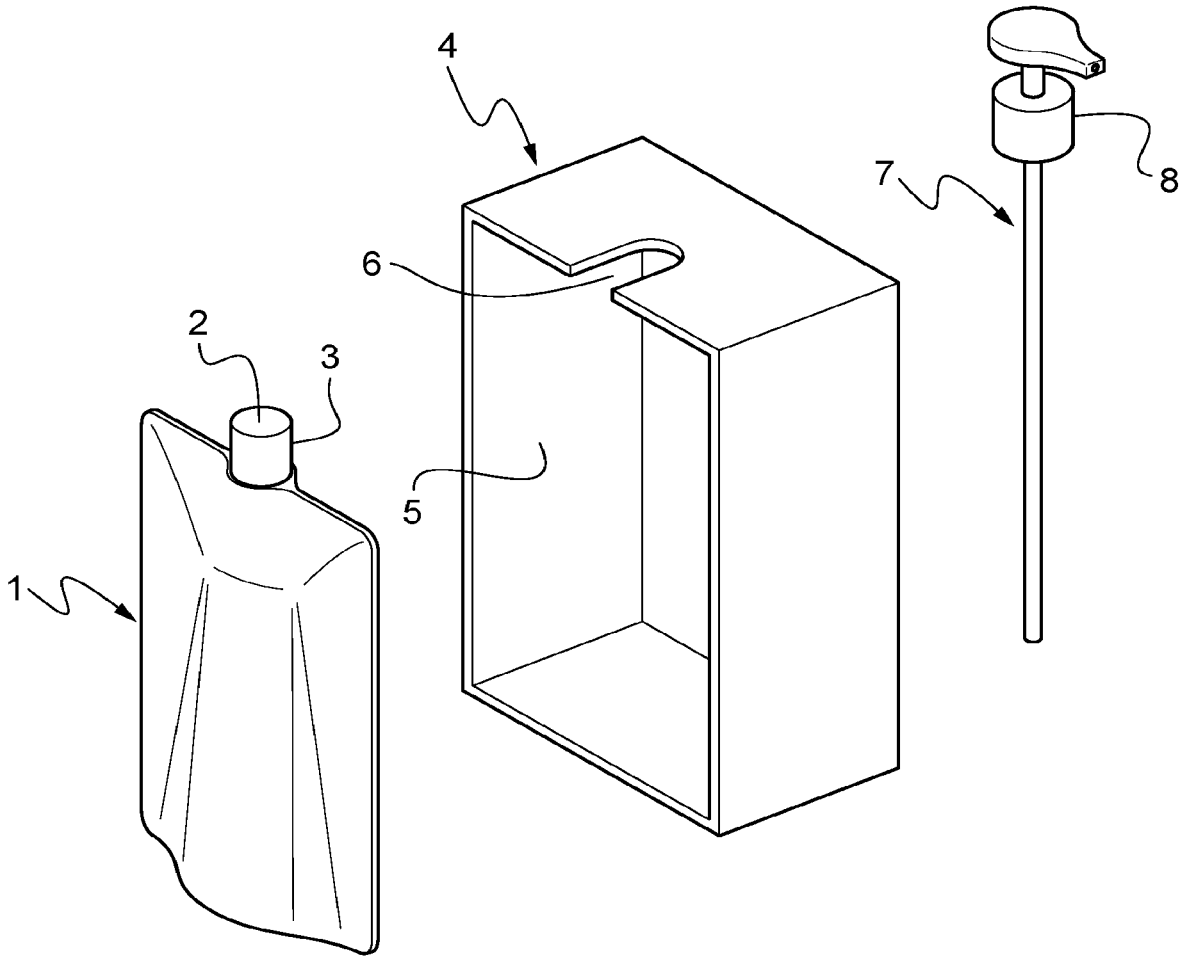
FIG. 1A illustrates a fluid dispenser comprising a flexible container, a rigid outer container and a dispensing member according to an embodiment of the invention.
Figure 1B:
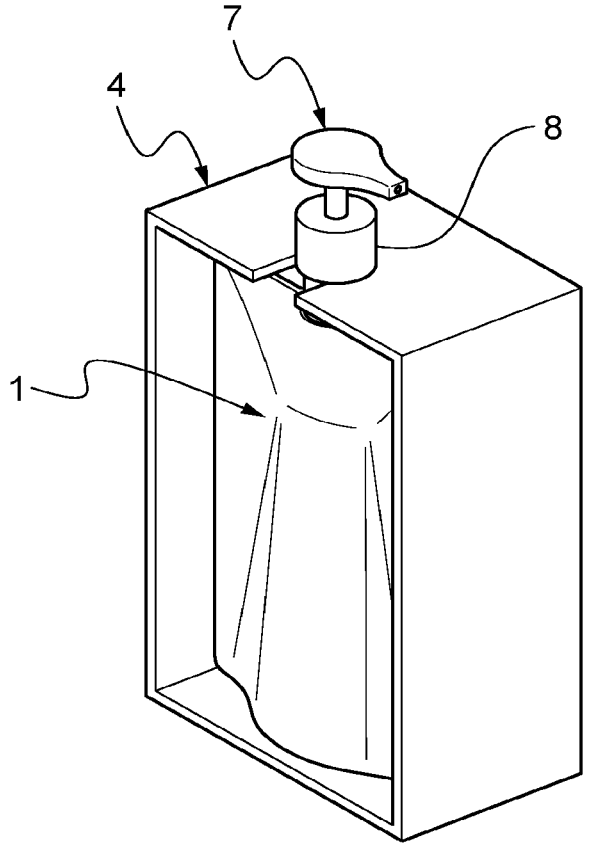
FIG. 1B illustrates the fluid dispenser components of FIG. 1A assembled together according to an embodiment of the invention.

Referring to FIGS. 1A and 1B, the fluid dispenser according to the invention comprises: a flexible container 1 containing the fluid (not shown), wherein the flexible container 1 comprises an opening 2 and a neck 3 disposed about the opening 2; a rigid outer container 4 adapted to house the flexible container 1, wherein the rigid outer container 4 comprises an installation opening 5 for insertion of the flexible container 1 within the rigid outer container 4 and a supply opening 6 for detachably engaging with the neck 3 of the flexible container 1; and a dispensing member 7 for drawing the fluid through the opening 2 in the flexible container 1, wherein the dispensing member 7 comprises a connection piece 8 for attaching to the neck 3 of the flexible container 1; and wherein the flexible container 1 is fixed within the rigid outer container 4 by directly engaging the neck 3 of the flexible container 1 with the supply opening 6 of the rigid outer container 4. In alternative embodiments, the flexible container may be fixed within the rigid outer container by indirectly engaging the neck of the flexible container with the supply opening of the rigid outer container, via the connection piece of the dispensing member or via the interconnection piece.

The fluid to be dispensed is contained within a flexible container 1, such as a bag or pouch, which can be inserted into the rigid outer container 4. Preferably, the flexible container 1 is made from a thin, tear-resistant material, for example, plastic (e.g., polyethylene, polypropylene, high density polyethylene, low density polyethylene, linear low density polyethylene, polyethylene terephthalate), polyamide, foil (e.g., aluminum), or laminated material (e.g., laminate of aluminum and plastic). The flexible container 1 can be made of opaque, transparent, semi-transparent materials or translucent, or a combination thereof. For example, a flexible container 1 may be made from an opaque or semi-transparent material with a transparent portion that enables the user to determine the amount of fluid remaining in the flexible container 1. Advantages of utilizing such a container include minimizing storage space and reducing the weight and the volume of waste as compared to rigid containers such as plastic bottles. In some embodiments, the flexible container 1 is designed to be disposed of after being emptied of its contents. In other embodiments, the flexible container 1 is designed to be reused, for example, by being refilled after each time it is emptied. In some embodiments, the flexible container 1 can be recycled after use.

Figure 2:
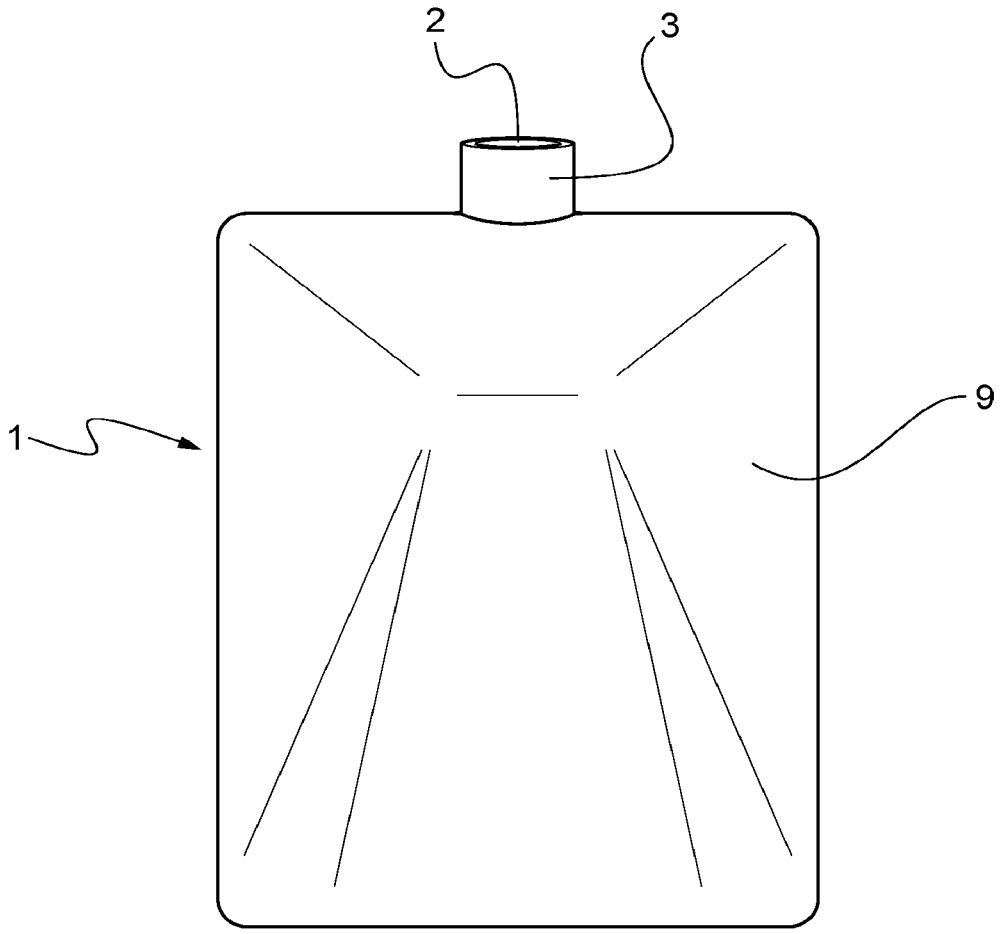
FIG. 2 illustrates a flexible container according to an embodiment of the invention.

Referring to FIG. 2, the flexible container 1 has a container portion 9, an opening 2 for delivering the fluid, and a neck 3 disposed around opening 2. The neck 3 can be made from the same material as the container portion 9 of the flexible container 1 or a different material. In order to facilitate attachment to the dispensing member 7 and/or to provide adequate support for the connection between the flexible container 1 and the rigid outer container 4, the neck 3 can be less flexible and more rigid than the container portion 9 of the flexible container 1, although preferably the neck 3 still retains some flexibility.

Figure 3:
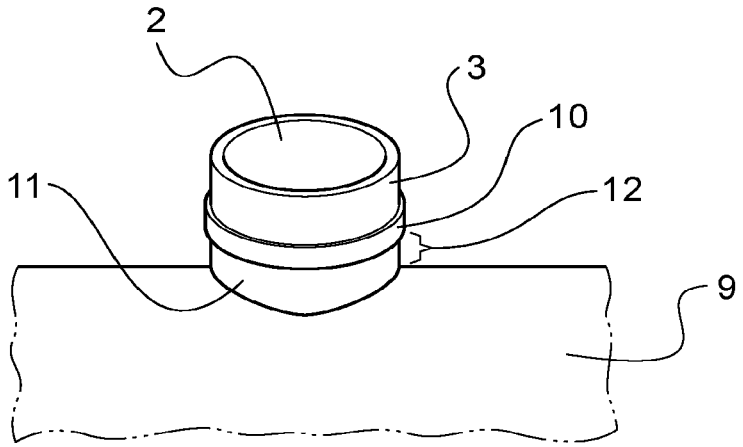
FIG. 3 illustrates a neck and annular ring according to an embodiment of the invention.

Referring to FIG. 3, in some embodiments, the neck 3 of the flexible container 1 comprises an annular ring 10 to facilitate the connection between the flexible container 1 and the rigid outer container 4. The annular ring 10 is positioned on the neck 3 to form a gap 11 having a certain height 12 between the bottom of the annular ring 10 and the top of the container portion 9. Height 12 of gap 11 is generally equal to or nearly equal to the thickness of the material that makes up the rigid outer container 4 surrounding the supply opening 6 to enable the flexible container 1 to be detachably fixed within the outer rigid container 4. In some embodiments, height 12 of gap 11 is smaller than the thickness of the material that makes up the rigid outer container 4 surrounding the supply opening 6. This embodiment requires a certain degree of flexibility of material that makes up the annular ring 10 and/or the top of the top of the container portion 9 in order for the neck 3 to fit within the supply opening 6. In other embodiments, height 12 of gap 11 is larger than the thickness of the material that makes up the rigid outer container 4 surrounding the supply opening 6.

In some embodiments, the neck 3 of the flexible container 1 comprises more than one annular ring, for example, two annular rings to facilitate the connection between the flexible container 1 and the rigid outer container 4. The annular rings are positioned on the neck 3 to form a gap having a certain height between the top annular ring and the bottom annular ring. The height of this gap is generally equal to or nearly equal to the thickness of the material that makes up the rigid outer container 4 surrounding the supply opening 6 to enable the flexible container 1 to be detachably fixed within the outer rigid container 4.

Figure 4:
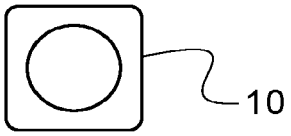
FIG. 4 is a top view of an annular ring with a square outer surface according to an embodiment of the invention.

In some embodiments, the outer surface of annular ring 10 is circular in shape. In other embodiments, the outer surface of annular ring 10 is an angular shape (i.e., triangular, square, pentagonal, hexagonal, etc.) designed to reversibly fit with a similar angular shape of the supply opening 6 of the rigid outer container 4, thus limiting the horizontal, vertical and/or rotational movement of the neck 3 of the flexible container 1 within the supply opening 6. A top view of an embodiment of an annular ring 10 with a square outer surface is illustrated in FIG. 4.

In some embodiments, the angular ring 10 includes a notch or groove that is designed to reversibly fit with a corresponding protrusion or tooth present in the supply opening 6 of the rigid outer container 4, thus limiting the horizontal, vertical and/or rotational movement of the neck 3 of the flexible container 1 within the supply opening 6. In other embodiments, the angular ring 10 includes a protrusion or tooth that is designed to reversibly fit with a corresponding notch or groove present in the supply opening 6 of the rigid outer container 4, thus limiting the rotational and/or horizontal movement of the neck 3 of the flexible container 1 within the supply opening 6.

Figure 5A:
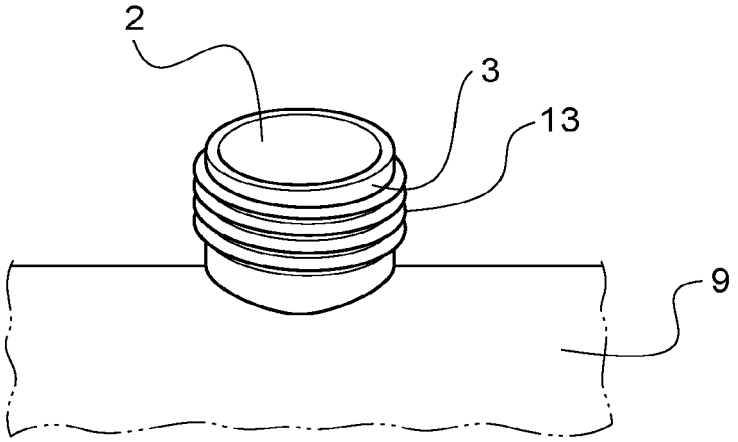
FIG. 5A illustrates a neck with screw threads according to an embodiment of the invention.

Referring to FIG. 5A, in some embodiments, the neck 3 of the flexible container 1 comprises outer screw threads 13 designed to engage with inner screw threads (not shown) of the connection piece 8 of the dispensing member 7. In some embodiments, the neck 3 contains both screw threads and an annular ring.

Figure 5B:
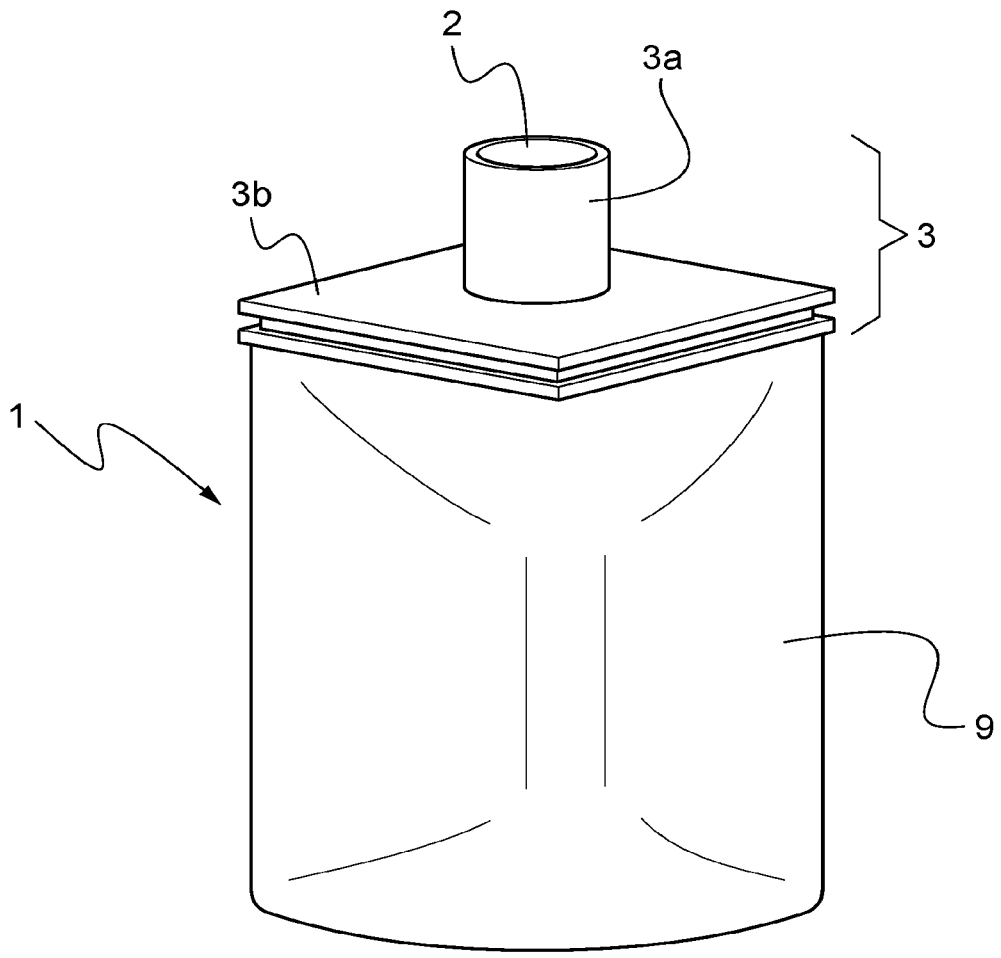
FIG. 5B illustrates a neck comprising an upper portion 3*a* and a lower portion 3*b* according to an embodiment of the invention.

Referring to FIG. 5B, in some embodiments, the neck 3 of the flexible container 1 comprises an upper portion 3*a*, which is designed to engage with the connection piece 8 of the dispensing member 7 (for example, by means of outer screw threads designed to engage with inner screw threads of the connection piece 8 of the dispensing member 7), and a lower portion 3*b* which is attached to the container portion 9. In some embodiments, the upper portion 3*a* and the lower portion 3*b* of neck 3 are different shapes. A non-limiting example is shown in FIG. 5B, wherein the upper portion 3*a* is cylindrical in shape (for example, to engage with a cylindrical connection piece 8 of dispensing member 7), and the lower portion 3*b* is elongated in order to match the dimensions of the container portion 9. In some embodiments, the lower portion 3*b* of neck 3 is further designed to facilitate the connection between the flexible container 1 and the rigid outer container 4, for example, by means of protrusions or grooves that enable the flexible container 1 to be detachably fixed within the outer rigid container 4. In these embodiments, the upper portion 3*a* and lower portion 3*b* of neck 3 can be less flexible and more rigid than the container portion 9 of the flexible container 1.

In some embodiments, in order to maintain freshness of the fluid (e.g., prevent oxidation), or to prevent contamination or tampering, the opening 2 of the flexible container 1 is covered or sealed with a foil-type cover or lid which can be removed before use. In some embodiments, the opening 2 of the flexible container 1 is covered with a removable cap, for example, a cap that contains inner screw threads that engage with the outer screw threads 13 of the neck 3. In some embodiments, the opening 2 of the flexible container 1 is covered or sealed with a foil-type cover or lid and also a removable cap.

The rigid outer container 4 is adapted to house the flexible container 1 and to hold it in place to enable the user to withdraw the fluid. The rigid outer container 4 can be made of any material that is capable of providing support to the flexible container 1 and withstanding the force of the dispensing unit 7 when in use, for example, plastic (e.g., polyethylene, high density polyethylene, polyvinyl chloride, polypropylene, polycarbonate, acrylonitrile butadiene styrene) metal (e.g., aluminum, stainless steel), wood or bamboo. The rigid outer container 4 can be made of material that is opaque, transparent, semi-transparent or translucent, or a combination thereof. For example, a rigid outer container 4 may be made from an opaque or semi-transparent material with a transparent portion that enables the user to determine the amount of fluid remaining in the flexible container 1.

The rigid outer container 4 can be of any geometric shape, for example, rectangular, cubic, cylindrical, oval cylindrical and the like. The dimensions of the rigid outer container 4 are large enough to contain the flexible container 1 when it is completely full of the fluid.

Figure 6:
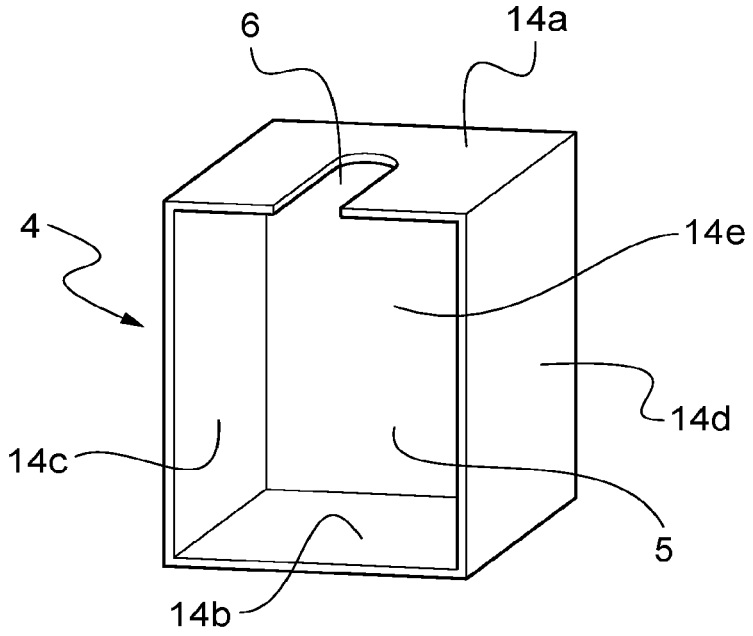
FIG. 6 illustrates a rigid outer container of unitary construction according to an embodiment of the invention.

Referring to FIG. 6, rigid outer container 4 comprises an installation opening 5 for insertion of the flexible container 1 within the rigid outer container 4 and a supply opening 6 for detachably engaging with the neck 3 of the flexible container 1. In the embodiment shown in FIG. 6, the rigid outer container 4 is a unitary construction and the installation opening 5 is defined by the open space between top 14*a*, bottom 14*b*, and sides 14*c* and 14*d*, and is opposite the front 14*e*. In other embodiments, front 14*e* may be absent and the rigid outer container 4 includes top 14*a*, bottom 14*b*, and sides 14*c* and 14*d*. In still other embodiments, sides 14*c* and 14*d* may be absent and the rigid outer container 4 includes top 14*a*, bottom 14*b*, and front 14*e*. In any of these embodiments, the flexible container 1 can be inserted into the rigid outer container 4 through the installation opening 5, and the neck 3 of the flexible container 1 engaged with the supply opening 6 of the rigid outer container 4 as described further herein.

Figure 7:
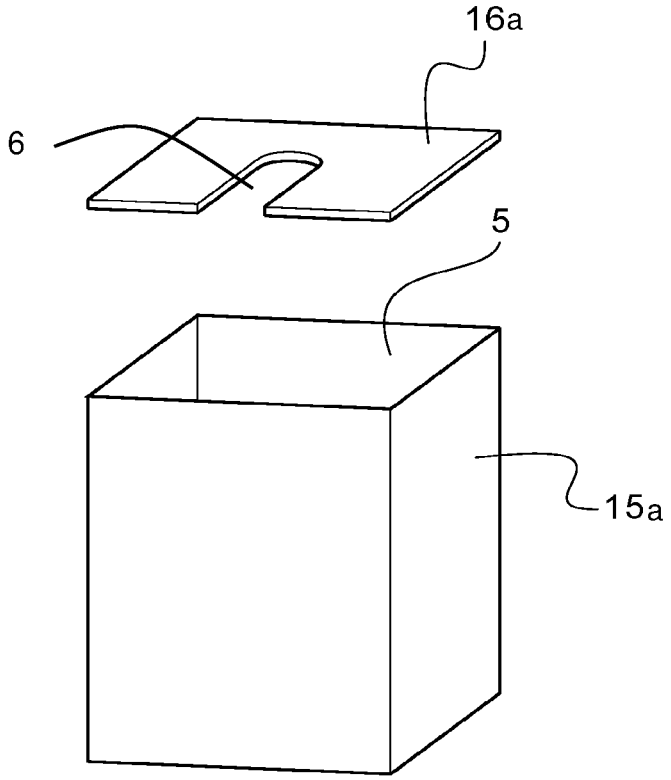
FIG. 7 illustrates a rigid outer container including a body and a removable cover according to an embodiment of the invention.

In another embodiment, the rigid outer container 4 includes two joinable parts, wherein one joinable part is movable into a position for allowing access to the installation opening 5 of the rigid outer container. Referring to FIG. 7, in some embodiments, the two joinable parts comprise a body 15*a* and a cover 16*a* that fits securely on the body 15*a* over the installation opening 5. In the embodiment illustrated in FIG. 7, the installation opening 5 and the corresponding cover 16*a* are located on the top of the body 15*a* and the cover 16*a* includes the supply opening 6. In other embodiments, as illustrated in FIG. 8, the installation opening 5 and the corresponding cover 16*b* are located on a side of the body 15*b*, and the body 15*b* includes the supply opening 6.

In some embodiments, the cover 16 is slightly larger than the top of the body 15, and the cover 16 includes a rim that runs long its outer edge in the downward direction such that when the cover 16 is placed on the body 15, the rim is in contact with the outside of the body 15, thus holding the cover 16 in place on the body 15. In other embodiments, the cover 16 is the same size as the top of the body 15, and the cover 16 includes a rim that runs parallel to its outer edge in the downward direction and is located a certain distance inward from the outer edge, such that when the cover 16 is placed on the body 15, the rim is in contact with the inside of the body 15, thus holding the cover 16 in place on the body 15. In yet another embodiment, the cover 16 is slightly smaller than the top of the body 15, and the body 15 includes a rim that runs parallel to the top edge of the installation opening 5 and is located a certain distance inward from the top edge of the installation opening 5, such that when the cover 16 is placed on the body 15, the bottom face of the cover 16 rests on the rim, thus holding the cover 16 in place on the body 15.

In some embodiments, the cover 16*a* is removable and separate from body 15*a*, such as the embodiment illustrated in FIG. 7. In some embodiments, the removable cover 16*a* can be locked or fixed in place on the body 15*a*, for example, by a slide-lock, twist-lock or bayonet-type mount.

Figure 8:
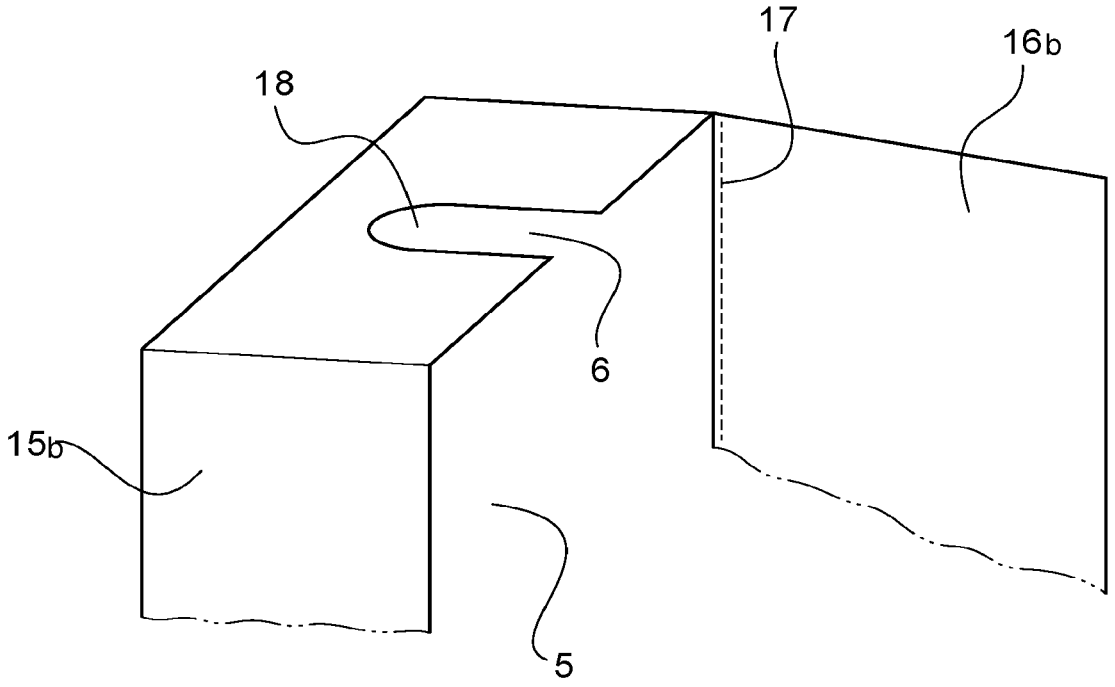
FIG. 8 illustrates a rigid outer container including a body and a cover attached to the body by a hinge according to an embodiment of the invention.
Figure 9:
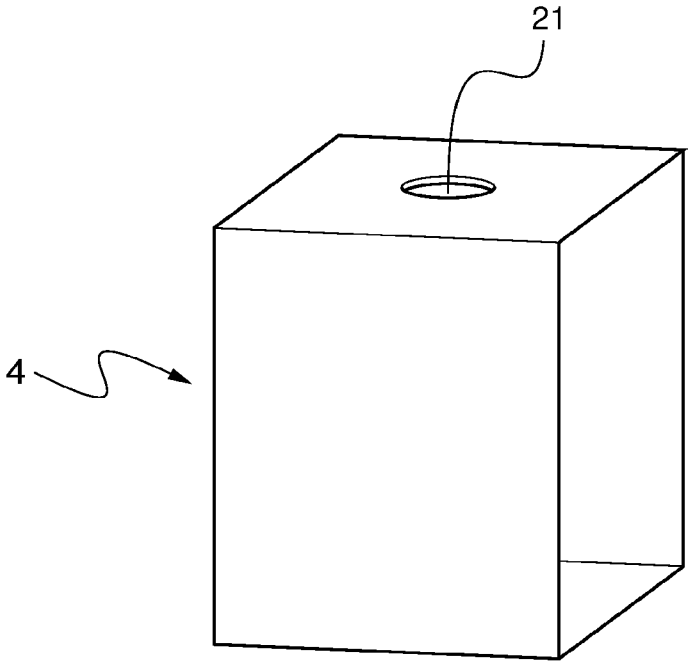
FIG. 9 illustrates a rigid outer container of unitary construction according to an embodiment of the invention.

In some embodiments, such as the embodiment illustrated in FIG. 8, the cover 16*b* is attached to the body 15*b*, for example, by means of a hinge 17. Such embodiments may include a latch or locking means on the body 15*b* and/or cover 16*b* in order to keep the cover 16*b* in the closed position.

In some embodiments, the supply opening 6 is a recess 18 in the rigid outer container 4, as illustrated in FIG. 8. In such embodiments, the neck 3 of the flexible container 1 is slid into the recess 18 either before or after the dispensing member 7 is attached to the neck 3.

For proper operation of the fluid dispenser, it is important to form a secure fit between the neck 3 of the flexible member 1 and the recess 18. In an alternative embodiment, the connection piece of the dispensing member or the interconnection piece may form a secure fit with the recess. To provide such a secure fit, in some embodiments, the supply opening 6 comprises a locking means for engaging the neck 3 of the flexible container 1, wherein the locking means limits horizontal, vertical and/or rotational movement of the neck 3 of the flexible container 1. In some embodiments, the width of the recess 18 may be slightly smaller than the diameter of the neck 3, provided the neck 3 is sufficiently flexible to slightly deform as it is fixed within the recess 18. Alternatively, in some embodiments the width of the recess 18 may be the same as or greater than the diameter of the neck 3. Such embodiments may be utilized with a flexible container 1 that includes an annular ring 10 disposed on the neck 3 (wherein the diameter of the annular ring is greater than the width of the recess 18), or with a dispensing member 7 that includes a connection piece 8 with a diameter that is greater than the width of the recess 18.

Figure 10A:
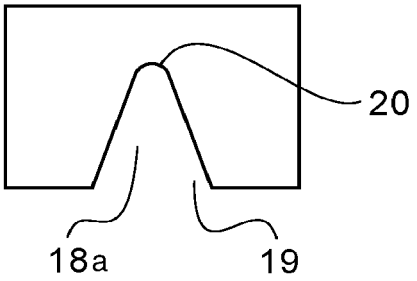
FIG. 10A is a top view of a supply opening in the form of a tapered recess according to an embodiment of the invention.
Figure 10B:
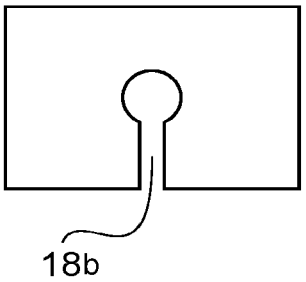
FIG. 10B is a top view of a supply opening in the form of a "lollipop" recess according to an embodiment of the invention.

As illustrated in FIG. 10A, another embodiment of a locking means includes a recess 18*a* that is wider at the edge nearest the installation opening 19 and tapers toward the end of the recess 20. In other embodiments, the recess 18*b* has a "lollipop" shape with a straight section that ends at a slightly wider circular portion (see, e.g., FIG. 10B).

In other embodiments of a locking means, the shape of the recess 18 is designed to receive the shape of the neck 3 and/or annular ring 10 of the flexible container 1. For example, the shape of the end of the recess 18 can be semicircular in order to receive a round neck 3 and/or annular ring 10 (see, e.g., FIGS. 1A, 1B, 6-8, 10A and 10B), or it can be angular in order to receive an angular-shaped (e.g., triangular, square, pentagonal, hexagonal, etc.) neck 3 and/or annular ring 10. In some embodiments, the recess 18 includes a protrusion or tooth that is designed to reversibly fit with a notch or groove present in the neck 3 or angular ring 10 of the flexible container; in other embodiments, the recess 18 includes a notch or groove that is designed to reversibly fit with a protrusion or tooth present in the neck 3 or angular ring 10 of the flexible container. In another embodiment, one or more seals (e.g., rubber, silicone, etc.) can line the edges of the recess 18 to securely and reversibly contact the neck 3. Each of these embodiments can serve not only to hold the flexible container 1 in place, but also to reduce horizontal, vertical and/or rotational movement of the neck 3 and flexible container 1, thus improving the performance of the fluid dispenser.

Figure 10C:
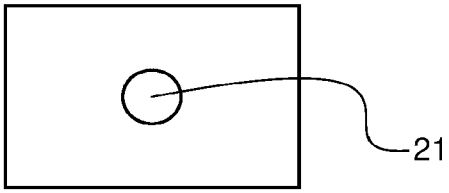
FIG. 10C is a top view of a supply opening in the form of a hole according to an embodiment of the invention.

In other embodiments the supply opening is a hole 21, as illustrated in FIG. 10C. In such embodiments, the neck 3 of the flexible container 1 is inserted through the hole 21 and then the dispensing member 7 is attached to the neck 3. In some embodiments, the hole 21 includes a locking means for engaging the neck 3 of the flexible container 1, wherein the locking means limits horizontal, vertical and/or rotational movement of the neck 3 of the flexible container 1. In some embodiments, the locking means is a protrusion or tooth that is designed to reversibly fit with a notch or groove present in the neck 3 or angular ring 10 of the flexible container 1; in other embodiments, the hole 21 includes a notch or groove that is designed to reversibly fit with a protrusion or tooth present in the neck 3 or angular ring 10 of the flexible container 1. In another embodiment, one or more seals (e.g., rubber, silicone, etc.) can line the edges of the hole 21 to securely and reversibly contact the neck 3. Each of these embodiments can serve not only to hold the flexible container 1 in place, but also to reduce horizontal, vertical and/or rotational movement of the neck 3 and flexible container 1, thus improving the performance of the fluid dispenser.

Figure 11:
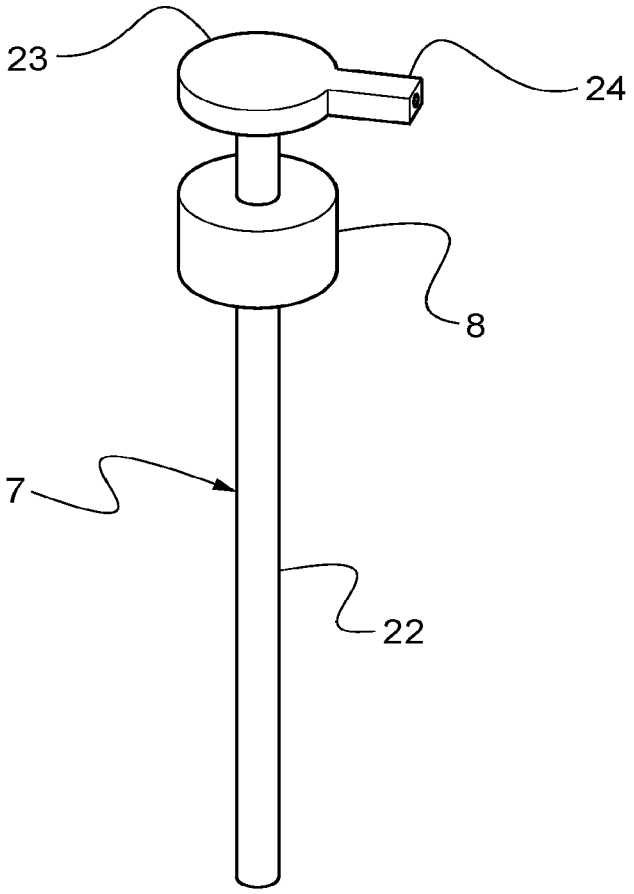
FIG. 11 illustrates a pump-type dispensing member according to an embodiment of the invention.
Figure 12:
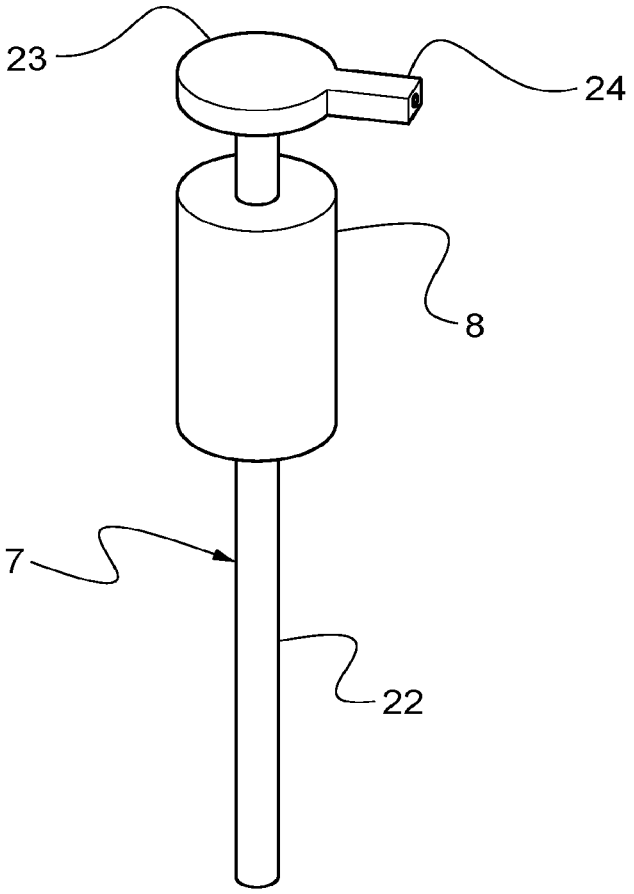
FIG. 12 illustrates a pump-type dispensing member according to an embodiment of the invention.
Figure 13:
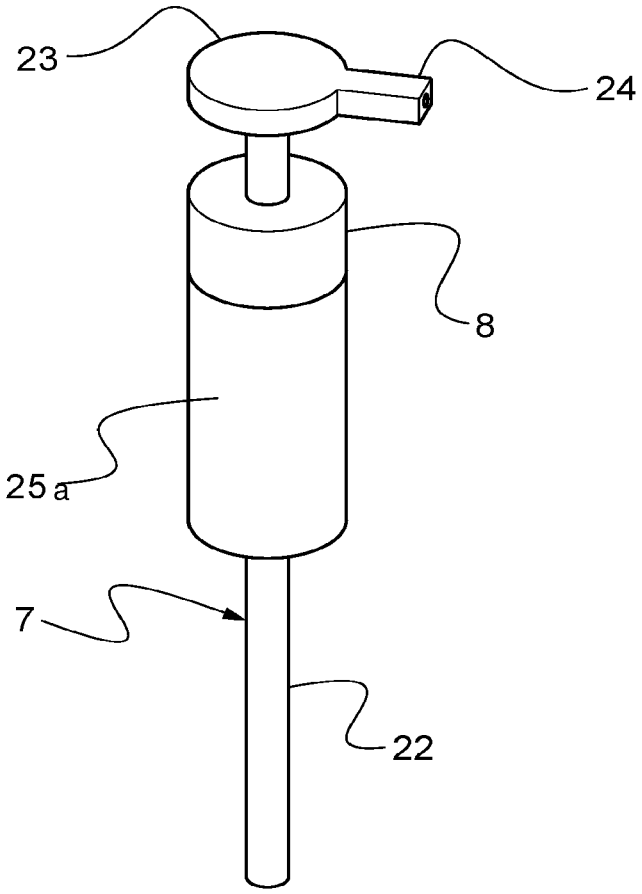
FIG. 13 illustrates a pump-type dispensing member and an interconnection piece according to an embodiment of the invention.
Figure 14:
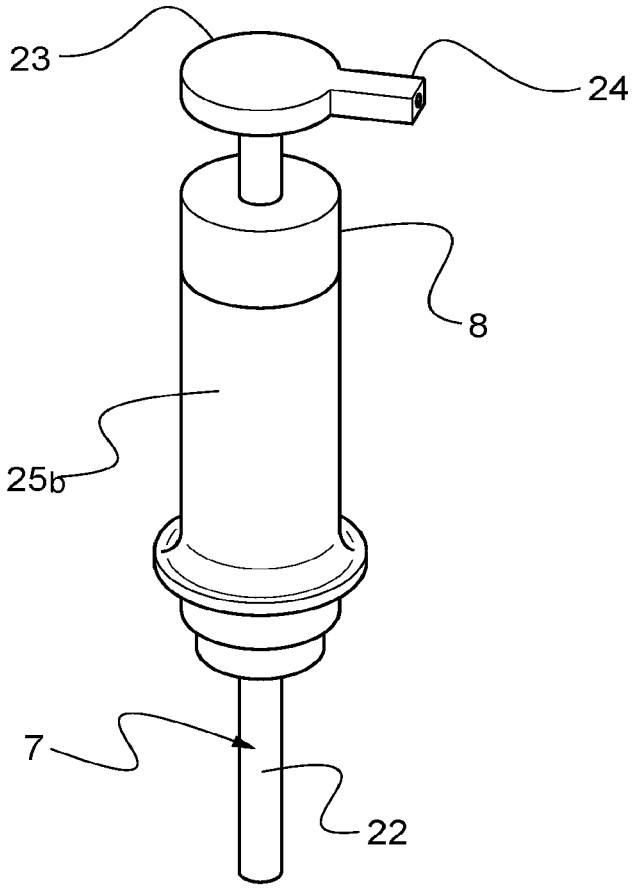
FIG. 14 illustrates a pump-type dispensing member and an interconnection piece according to an embodiment of the invention.

The dispensing member 7 for drawing the fluid through the opening 2 in the flexible container 1 can be any conventional pump, including the lotion-pump type or spray-pump type apparatus. The type of dispensing member 7 should be matched with the type of fluid being dispensed (e.g., spray-type for lower-viscosity fluids, lotion spray-type for higher-viscosity fluids). FIG. 11 illustrates an example of a pump-type fluid dispensing member 7, which includes a conveying tube 22, a connection piece 8 for attaching to the neck 3 of the flexible container 1, and a moveable head 23 which has a radially projecting outlet 24. FIG. 12 illustrates an example of a pump-type fluid dispensing member 7, which includes a conveying tube 22, an elongated connection piece 8 for attaching to the neck 3 of the flexible container 1, and a moveable head 23 which has a radially projecting outlet 24. FIG. 13 illustrates an example of a pump-type fluid dispensing member 7 and an interconnection piece 25*a* for attaching to the neck 3 of the flexible container 1, wherein the pump-type fluid dispensing member 7 includes a conveying tube 22, a connection piece 8 for attaching to the interconnection piece 25*a*, and a moveable head 23 which has a radially projecting outlet 24. FIG. 14 illustrates an example of a pump-type fluid dispensing member 7 and an interconnection piece 25*b* for attaching both to the neck 3 of the flexible container 1 and to the supply opening of the rigid outer container 4, wherein the pump-type fluid dispensing member 7 includes a conveying tube 22, a connection piece 8 for attaching to the interconnection piece 25*b*, and a moveable head 23 which has a radially projecting outlet 24.

The connection piece 8 can attach to the neck 3 by any conventional means, such as screw threads, bayonet, clipping, etc. In some embodiments, the connection piece 8 reversibly attaches to the neck 3 of the flexible container 1, so that the flexible container 1 can be removed after use and the dispensing member 7 can be reused. In some embodiments, the connection piece 8 is an annular collar with inner screw threads designed to engage with outer screw threads (13) of the neck 3 of the flexible container 1 (see, e.g., FIG. 5). In some embodiments, the connection piece 8 irreversibly attaches to the neck 3 of the flexible container 1, so that the flexible container 1 and dispensing member 7 are both disposed of after use.

The conveying tube 22 can be flexible or rigid. In some embodiments, the conveying tube 22 is straight; in other embodiments, the conveying tube 22 is angled or curved. The conveying tube 22 is of sufficient length to reach to or near to the bottom of the flexible container 1 so that the majority of the fluid can be dispensed from the flexible container 1.

In order to use the fluid dispenser, the conveying tube 22 of the dispensing member 7 is inserted into the neck 3 of the flexible container 1 and through the opening 2. The dispensing member 7 is attached to the neck 3 of the flexible container 1 by way of the connection piece 8 (e.g., by screwing or clamping). Then flexible container 1 is inserted into the installation opening 5 of the rigid outer container 4 by engaging the neck 3 of the flexible container 1 with the supply opening 6 of the rigid outer container 4 (e.g., by sliding the neck 3 into the recess 18). Once the flexible container 1 is secure within the rigid outer container 4, then the dispensing member 7 may be actuated to dispense fluid from the flexible container 1 (e.g., by pressing down the movable head 23 of the dispensing member 7, thus suctioning the fluid through conveying tube 22 and out through the outlet 24).

Alternatively, prior to attaching the dispensing member 7 to the neck 3 of the flexible container 1, the flexible container 1 can be inserted into the installation opening 5 of the rigid outer container 4 by engaging the neck 3 of the flexible container 1 with the supply opening 6 of the rigid outer container 4 (e.g., by sliding the neck 3 into the recess 18 or by inserting the neck 3 into the hole 21). Once the flexible container 1 is so situated, the dispensing member 7 can be attached to the neck 3 and the fluid dispensed.

A fluid dispenser according to the invention may be used to dispense any fluid. Suitable non-limiting examples include hair products (e.g., shampoo, conditioner, masks, dyes, etc.), cleansing products (e.g., soap, facial scrub, hand sanitizer, etc.), skin care products (e.g., moisturizer, hand/face/body lotion, sunblock), and fragrances. The size of the fluid dispenser components, the materials that make up the fluid dispenser components, and the type of dispensing member 7 (e.g., lotion-pump type, spray-pump type, etc.) can be modified to accommodate the particular fluid being dispensed.

Variations and modifications of the invention and further embodiments thereof, in addition to those described herein, will become apparent to those skilled in the art from the full contents of this document. The subject matter herein contains information, exemplification and guidance that can be adapted to the practice of this invention in its various embodiments and equivalents thereof. It is intended that the appended claims cover all such variations, modifications, embodiments and equivalents.

What is claimed is:

1. A fluid dispenser comprising:

a flexible container (1) adapted to contain a fluid, wherein the flexible container (1) comprises an opening (2) and a neck (3) disposed about the opening (2);

a rigid outer container (4) adapted to house the flexible container (1), wherein the rigid outer container (4) comprises an installation opening (5) for insertion of the flexible container (1) within the rigid outer container (4) and a supply opening (6) for detachably engaging with the neck (3) of the flexible container (1); and a dispensing member (7) for drawing the fluid through the opening (2) in the flexible container (1), wherein the dispensing member (7) comprises a connection piece (8) for attaching to the neck (3) of the flexible container (1);

wherein the flexible container (1) is fixed within the rigid outer container (4) by engaging the neck (3) of the flexible container (1) with the supply opening (6) of the rigid outer container (4);

wherein the connection piece (8) of the dispensing member (7) is indirectly attached to the neck (3) of the flexible container (1); and further comprising an interconnection piece for interconnecting the connection piece (8) of the dispensing member (7) and the neck (3) of the flexible container (1);

wherein the supply opening (6) is detachably and indirectly engaged with the neck of the flexible container (1).

2. The fluid dispenser of claim 1, wherein the rigid outer container (4) comprises two joinable parts, wherein one joinable part is movable into a position for allowing access to the installation opening (5) of the rigid outer container (4).

3. The fluid dispenser of claim 2, wherein the two joinable parts comprise a body (15) and a cover (16), wherein the body comprises the installation opening (5) and the cover comprises the supply opening (6).

4. The fluid dispenser of claim 3, wherein the cover (16) is detachably joined to the body (15).

5. The fluid dispenser of claim 3, wherein the cover (16) is joined to the body (15) by means of a hinge (17).

6. The fluid dispenser of claim 2, wherein the two joinable parts comprise a body and a cover, wherein the body comprises the installation opening (5) and the supply opening (6).

7. The fluid dispenser of claim 1, wherein the rigid outer container (4) comprises at least one transparent or semi-transparent portion.

8. The fluid dispenser of claim 1, wherein the interconnection piece interconnects the supply opening (6) of the rigid outer container (4) and the neck (3) of the container (1).

9. The fluid dispenser of claim 1, wherein the supply opening (6) engages the neck (3) of the flexible container (1) or the connection piece (8) of the dispensing member (7) or the interconnection piece, such that least one of horizontal, vertical and rotational movement of the neck (3) of the flexible container (1) or the connection piece (8) of the dispensing member (7) or the interconnection piece is limited.

10. The fluid dispenser of claim 1, wherein the neck (3) of the flexible container (1) or the connection piece (8) of the dispensing member (7) or the interconnection piece comprises at least one annular ring (10), wherein the at least one annular ring (10) detachably engages with the supply opening (6) thereby fixing the flexible container (1) or the dispensing member (7) or the interconnection piece within the rigid outer container (4).

11. The fluid dispenser of claim 1, wherein the dispensing member (7) further comprises a pump means and a conveying tube (22), wherein the conveying tube (22) is disposed within the flexible container (1) when the connection piece (8) of the dispensing member (7) is attached to the neck (3) of the flexible container (1).

12. A fluid dispensing system comprising the fluid dispenser according to claim 1 and a fluid, wherein the fluid is contained in the flexible container (1) of the fluid dispenser and dispensed via the dispensing member (7).

13. A method for assembling the fluid dispenser according to claim 1, comprising the following steps:

providing the flexible container (1) comprising an opening (2) and a neck (3) disposed about the opening (2);

providing the rigid outer container (4) comprising an installation opening (5) and a supply opening (6);

providing the dispensing member (7) comprising a connection piece (8);

providing at least one interconnection piece;

attaching, indirectly with the interconnection piece, the connection piece (8) of the dispensing member (7) to the neck (3) of the flexible container (1);

inserting the flexible container (1) within the rigid outer container (4) via the installation opening (5);

detachably engaging the supply opening (6) of the rigid outer container (4) with the neck (3) of the flexible container (1), indirectly with the connection piece of the dispensing member or the optional interconnection piece, thereby detachably fixing the flexible container (1) within the rigid outer container (4).

14. A fluid dispenser comprising:

a flexible container (1) adapted to contain a fluid, wherein the flexible container (1) comprises an opening (2) and a neck (3) disposed about the opening (2);

a rigid outer container (4) adapted to house the flexible container (1), wherein the rigid outer container (4) comprises an installation opening (5) for insertion of the flexible container (1) within the rigid outer container (4) and a supply opening (6) for detachably engaging with the neck (3) of the flexible container (1); and a dispensing member (7) for drawing the fluid through the opening (2) in the flexible container (1), wherein the dispensing member (7) comprises a connection piece (8) for attaching to the neck (3) of the flexible container (1);

wherein the flexible container (1) is fixed within the rigid outer container (4) by engaging the neck (3) of the flexible container (1) with the supply opening (6) of the rigid outer container (4);

wherein the connection piece (8) of the dispensing member (7) is indirectly attached to the neck (3) of the flexible container (1); and further comprising an interconnection piece for interconnecting the connection piece (8) of the dispensing member (7) and the neck (3) of the flexible container (1);

wherein the supply opening (6) is detachably and indirectly engaged with the neck of the flexible container (1);

wherein the interconnection piece is assembled prior to use of the dispenser.

* * * * *